US009403269B1

(12) United States Patent
Typrowicz

(10) Patent No.: US 9,403,269 B1
(45) Date of Patent: Aug. 2, 2016

(54) DUAL-MATERIAL PAINTBRUSH HANDLE WITH INTERNAL FIXATION

(71) Applicant: Work Tools International, Inc., Largo, FL (US)

(72) Inventor: Thomas G Typrowicz, Largo, FL (US)

(73) Assignee: WORK TOOLS INTERNATIONAL, INC., Largo, FL (US)

( * ) Notice: Subject to any disclaimer, the term of this patent is extended or adjusted under 35 U.S.C. 154(b) by 0 days.

(21) Appl. No.: 14/811,895

(22) Filed: Jul. 29, 2015

(51) Int. Cl.
*B25G 3/12* (2006.01)

(52) U.S. Cl.
CPC ..... *B25G 3/12* (2013.01)

(58) Field of Classification Search
CPC ..... A46B 2200/20; A46B 2200/202; A46B 5/02; A46B 5/021; A46B 5/0095; A46B 5/002; A46B 5/0062; A46B 5/0066; A46B 7/04; A46B 7/042; A46B 3/12
USPC ..... 15/176.1, 176.6, 202
See application file for complete search history.

(56) References Cited

U.S. PATENT DOCUMENTS

| | | | | |
|---|---|---|---|---|
| 2,664,582 | A | 1/1945 | Kammann | |
| 5,752,287 | A | 5/1998 | Wheat | |
| 6,408,474 | B1 * | 6/2002 | Husted | A46B 3/12 15/143.1 |
| 2002/0010975 | A1 | 1/2002 | Walsh | |
| 2014/0137349 | A1 | 5/2014 | Newman | |
| 2014/0173839 | A1 | 6/2014 | Henderson | |

FOREIGN PATENT DOCUMENTS

| | | |
|---|---|---|
| EP | 0872311 | 10/1998 |
| FR | 2944195 | 10/2010 |
| GB | 2288727 | 1/1995 |

* cited by examiner

*Primary Examiner* — Monica Carter
*Assistant Examiner* — Stephanie Berry
(74) *Attorney, Agent, or Firm* — Larson & Larson, P.A.; Justin P. Miller; Patrick A. Reid

(57) ABSTRACT

The Dual-material Paintbrush Handle with Internal Fixation is comprised of two primary components. The first component is the flexible upper section that contacts the user's hand. The second component is the lower transition section, which acts to transition from the softer and more flexible first component to the ferrule, which is generally rigid. The lower transition section includes connection locations for the ferrule, and penetrations through which the soft upper section penetrates, stabilizing the connection between the upper and lower sections.

12 Claims, 8 Drawing Sheets

DUAL-MATERIAL PAINTBRUSH HANDLE WITH INTERNAL FIXATION

CROSS-REFERENCE TO RELATED APPLICATION

This application claims priority to U.S. Design patent application No. 29/523,418 titled Silicone-handled Paintbrush, the disclosure of which is hereby incorporated by reference.

FIELD

This invention relates to the field of paintbrushes and more particularly to a paintbrush handle made of a combination of pliable and stiff materials.

BACKGROUND

When in use, a paintbrush is in constant contact with the painter's hand. The hand comes into the most contact with the paintbrush handle, which rests on the hand between the thumb and forefinger. The paintbrush handle is held in place by the clamping action of the bony portions of the thumb and forefinger.

The result is a concentration of pressure on portions of the hand with little padding. Thus these bony portions of the hand become fatigued or bruised by the long periods of time they remain compressed against the paintbrush handle. Given that most paintbrush handles are made of wood, a stiff material, the paintbrush handle does little to spread the load.

What is needed is a handle that is soft enough to be comfortable in the hand, but matches the structural integrity of a stiffer material.

SUMMARY

The invention described within is a paintbrush that includes a handle made of two materials. The upper material, the material in primary contact with the user's hand, is a soft material.

The lower material, or the material that bridges the connection between the softer upper material and the ferrule, is a stiffer material.

The result is a paintbrush that is comfortable for a painter to hold because the bony portions of painter's hand are in contact with the soft portions of the brush, but is structurally sound because the lower material that forms the transition connection between the soft material and the hard ferrule construction.

TERMINOLOGY

As used herein, a paintbrush is any collection of filaments or bristles joined to a handle, used to transfer paint to a surface. For example, a paintbrush that can transfer paint, lacquer, varnish, stain, water sealant, and the like from a container to a surface.

Filament refers to any fiber, strand, or string-like element that, when collected together with other filaments, forms the brush head. A filament can be a natural fiber (e.g., animal hair) or a synthetic fiber (e.g., nylon, polybutylene).

A plug may be placed between the bristles to spread the bristles outward toward the sleeve so that the bristles are wedged between the plug and the sleeve.

The bristles and plug are often adhered together by adhesive, such as epoxy resins. Together the bristles, the plug, and the adhesive form a "knot" that retains the bristles in the sleeve.

Filaments are attached to the handle by way of a sleeve or ferrule that circumscribes an end of the bristles and a mating end of the handle.

The ferrule is affixed to the handle by small nails, known as brad nails, by simple compression, by the application of adhesive, or by other known attachment methods.

The handle itself can be of a multiplicity of shapes, including rat tail, beaver tail, and a handle often shorter than the filaments, known as a short handle. The handle can be of many materials, such as wood, rubber, plastic, and others.

The Components of the Disclosed Handle

The Dual-material Paintbrush Handle with Internal Fixation is comprised of two primary components. The first component is the flexible upper section that contacts the user's hand. The second component is the lower transition section, which acts to transition from the softer and more flexible first component to the ferrule, which is generally rigid. The lower transition section includes connection locations for the ferrule, and penetrations through which the soft upper section extends.

The connection between the flexible section and transition section is permanent. The flexible section and transition section are mated to one-another during assembly, or manufactured as one piece. The resulting connection cannot be undone in the absence of destructive separation by cutting or breaking.

As a result, the two components are joined inseparably.

Flexible Section

The flexible section is constructed from a material that is comfortable against the user's hand, with a friction coefficient high enough for the paintbrush to be easily held and used, without concern that the brush will slip out of the hand.

Such materials are elastomers or polymers, including many types of rubber. For example, materials referred to as silicone.

Transition Section

The transition section is made of a stiffer material than the upper section. There is little or no contact between a user's hand and the transition section, thus comfort is less of an issue.

Instead, the primary issue is a solid and stable connection to the ferrule.

Anticipated materials include rigid and semi-rigid plastics, as we as wood or metal.

The transition section provides an important connection between the flexible handle and rigid ferrule. Inserting a flexible silicone handle into a rigid ferrule would lead to a brush with a short life, having a tendency to separate at the connection point between the handle and the ferrule.

It is anticipated that the ferrule may be combined with the transition section, creating a hybrid ferrule/transition section.

Connection Between the Two Sections

The connection between the transition section and flexible section is mechanical. The flexible section has projections that extend beyond its lower interfacing surface. These projections coincide with penetrations, channels, or bores within the transition section. These penetrations, channels, or bores can be in the shape of a circle, square, triangle, or other similar shape. The projections pass through the penetrations, creating a mechanical connection between the two sections.

The projections can also be wide and long, acting more as a tongue and groove joint rather than individual connections. To analogize to woodworking, the joint between the two sections can be similar to a doweled join, or a mortise and tenon.

Despite this mechanical connection, it is possible that the projections may be pulled through the channels. Thus, the projections are optionally terminated in locking tips. Each locking tip is of a size greater than the channel, preventing the projection from pulling out.

Construction of this arrangement may be manufacturing each part individually and later assembling by pressing the projections through the channels. Alternatively, the parts may be molded into one-another using a co-molding or two-shot molding process.

Additionally, the locking tips may be bridged to connect multiple protrusions. Because these larger locking tips cannot pass through the channels, such an arrangement may require molding parts of the flexible section inside the transition section.

Given the limited space available in the cross section of a paintbrush, increasing the number of protrusions reduces the size of each protrusion. There will be a limit at the point at which the protrusions are too small to be molded. But the disclosed invention can have as few as a single protrusion, or as many as can be practically molded.

Fixation Sections within the Transition

The space within the transition section is limited as a practical matter. A larger transition section is desirable from the perspective of structural stability because greater internal dimensions allow for larger and longer protrusions, thereby helping to lock together the transition section and flexible section. But altering the size of the transition section affects other aspects of the handle, and correspondingly the brush.

If the flexible section is kept the same length, and the transition section is made longer, the resulting brush may be too long to precisely control.

Decreasing the length of the flexible section to make space for a longer transition section is also non-ideal because the flexible handle is attractive to users because of its comfort.

As a compromise, the transition section is increased in size at one end, absorbing a portion of what would be the flexible section. This creates a region of greater structural stability by being larger in size. And there is no detriment to user comfort because the region of the flexible section in question does not normally contact the user's hand. A smaller paintbrush handle, as shown in the figures, is meant to be held like a pencil. As a result, the lower portion of the ferrule/transition piece does not contact the user's hand, and thus comfort is not sacrificed.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
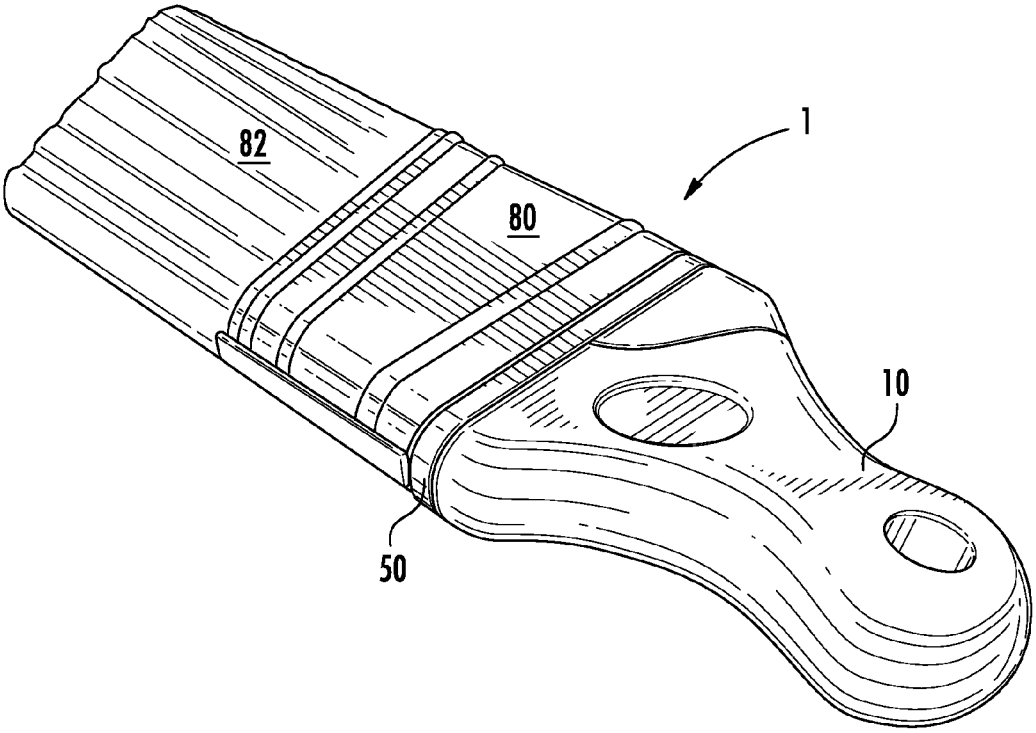
FIG. 1 is an overall view of the Dual-material Paintbrush Handle with Internal Fixation affixed to a ferrule with bristles.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an overall view of the Dual-material Paintbrush Handle with Internal Fixation affixed to a ferrule with bristles is shown. The Dual-Material Paintbrush Handle with Internal Fixation 1 includes a flexible section 10, joined to a transition section 50. Also shown are the ferrule 80 and bristles 82 of a typical paintbrush.

Figure 2:
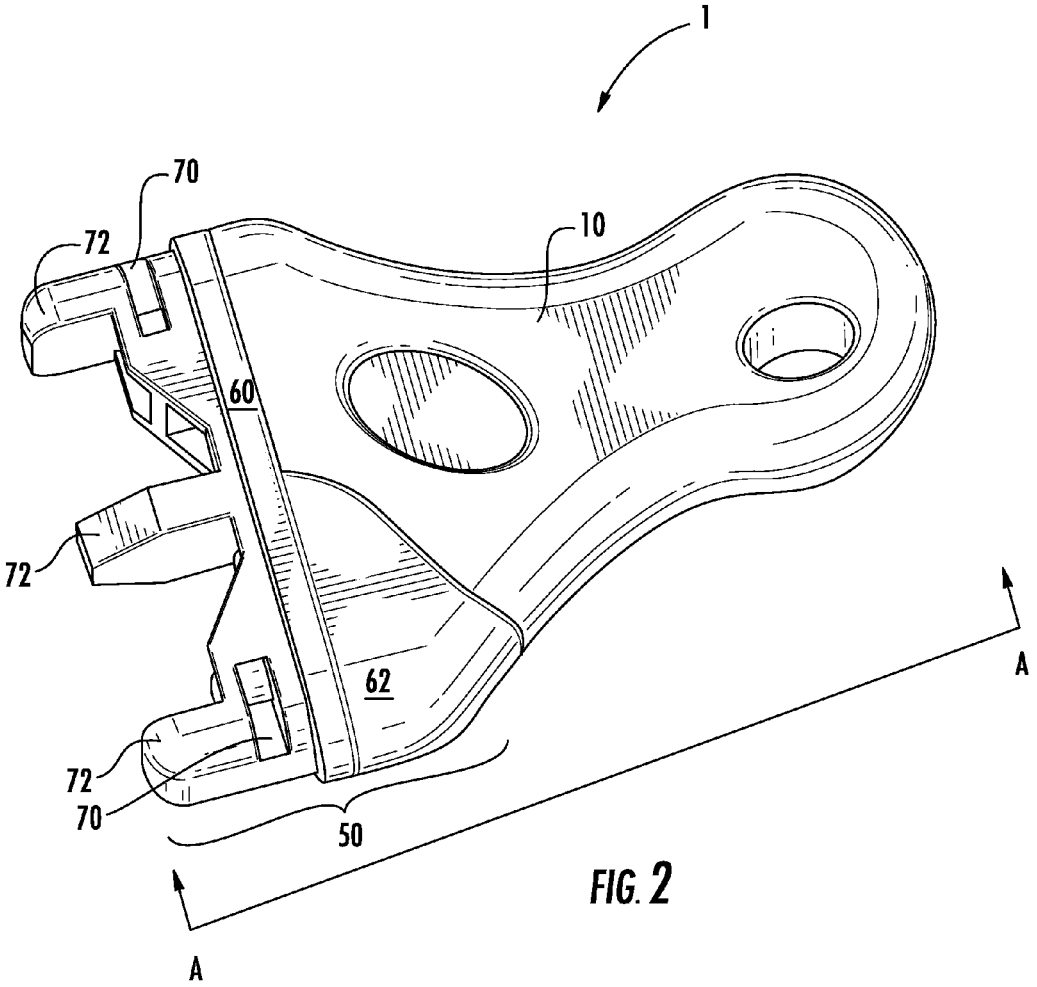
FIG. 2 is a view of the Dual-material Paintbrush Handle with Internal Fixation.

Referring to FIG. 2, a view of the Dual-material Paintbrush Handle with Internal Fixation is shown.

The transition section 50 is again shown, including the two fixation sections 60/62. The standard fixation section 60 is smaller, allowing for the flexible handle 10 to nearly abut the connection point for the ferrule. This maximizes the size of the flexible section 10, increasing user comfort.

Also shown is the enlarged fixation section 62. As shown, it is of a greater size than the standard fixation section 60. As a result a greater internal space is available for connection to the flexible section 10. This is better shown in the other figures.

For connection to the ferrule, the transition section 50 includes the indent for ferrule attachment 70 and fingers 72. The indent for ferrule attachment 70 allows a metal ferrule to grip the transition section 50. The fingers 72 lengthen the transition section 50 increasing stability during use and providing additional space that the adhesive used to cement the bristles can fill.

Figure 3:
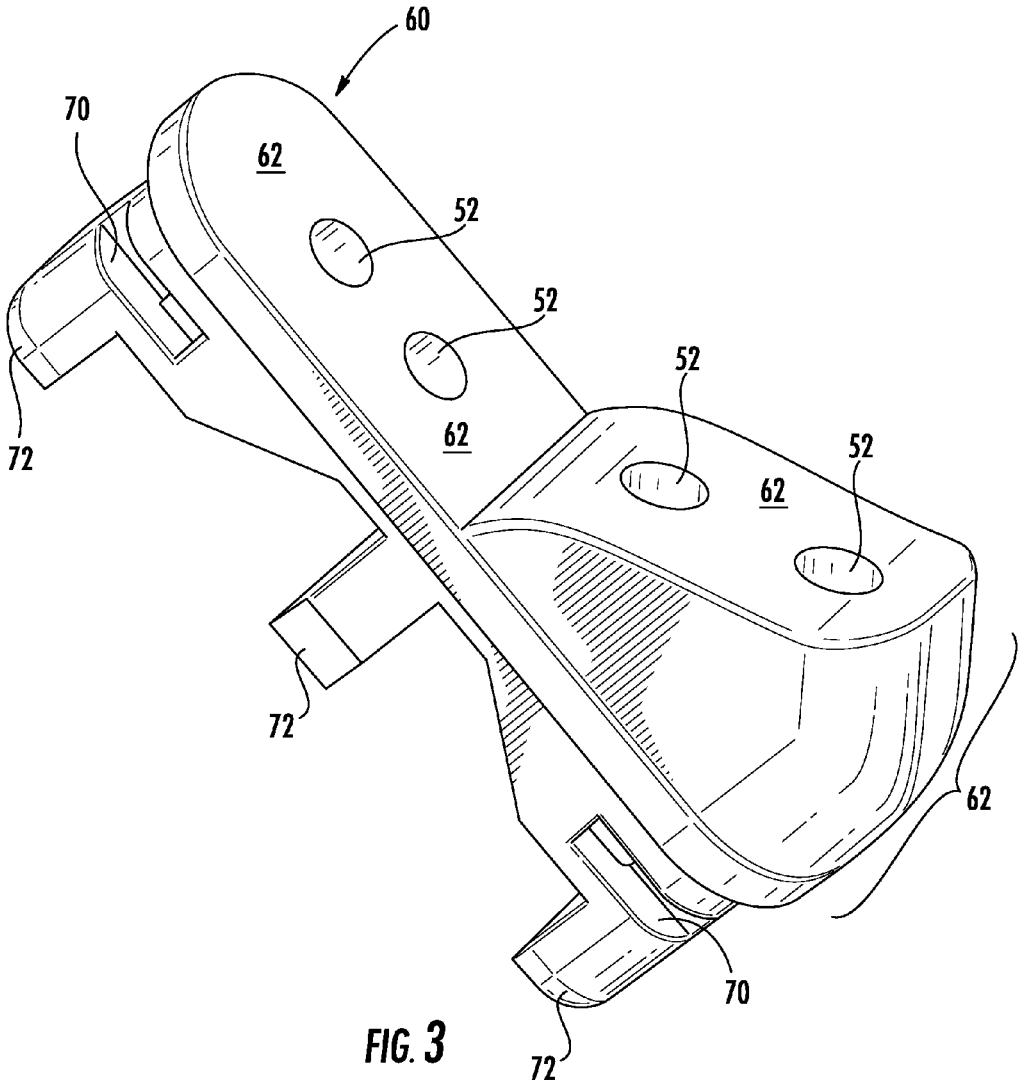
FIG. 3 is a view of the lower portion, or transition section, of the Dual-material Paintbrush Handle with Internal Fixation.

Referring to FIG. 3, a view of the lower portion, or transition section, of the Dual-material Paintbrush Handle with Internal Fixation is shown.

Bores 52 provide an entrance for the projections (not shown) to penetrate, locking the flexible section and transition section 50 together.

Again shown are the standard fixation section 60 and the enlarged fixation section 62.

The lower interface surface 66 is the portion of the transition section 50 that will rest against the upper interface surface 40 of flexible section 10.

Figure 4:
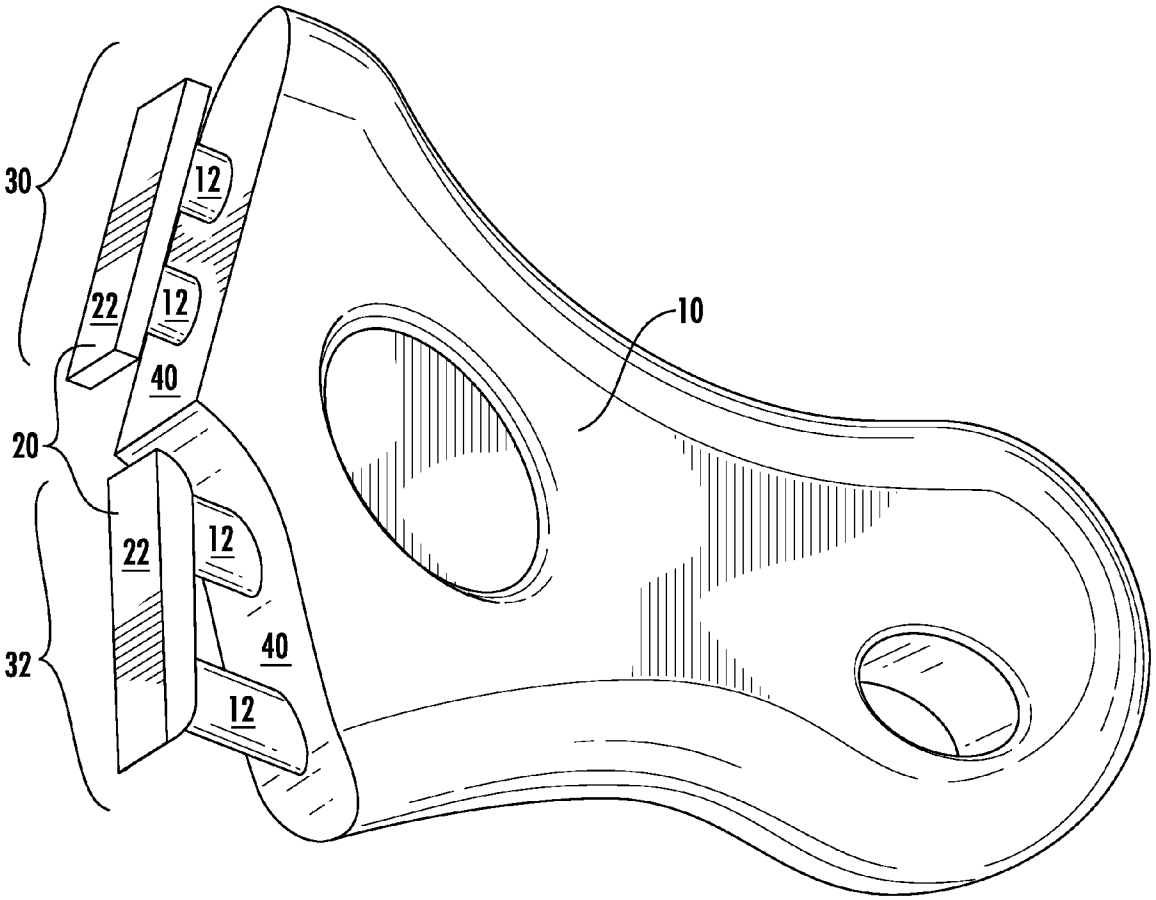
FIG. 4 is a view of the upper portion, or flexible section, of the Dual-material Paintbrush Handle with Internal Fixation.

Referring to FIG. 4, a view of the upper portion, or flexible section, of the Dual-material Paintbrush Handle with Internal Fixation is shown. Flexible section 10 is shown, including multiple projections 12 terminating in locking tips 20. In this embodiment the locking tips 20 are bridged locking tips 22, wherein a single locking tip 20 connects multiple projections 12. A bridged locking tip 22 provides additional protection against the projection 12 being pulled through the bores 52 (not shown) of the transition piece.

Also shown are the two sections of the flexible section 10 that correspond to the fixation sections 60/52 of the transition section 50. standard fixation section 60 and enlarged fixation section 62. Specifically, the shallow interface 30 is intended to interact with the standard fixation section 60. Enlarged interface 32 is intended to interact with the enlarged fixation section 62, providing the additional structural support.

The upper interface surface 40 is the portion of the flexible section 10 that will rest against the lower interface surface 66 of flexible section 10.

Figure 5:
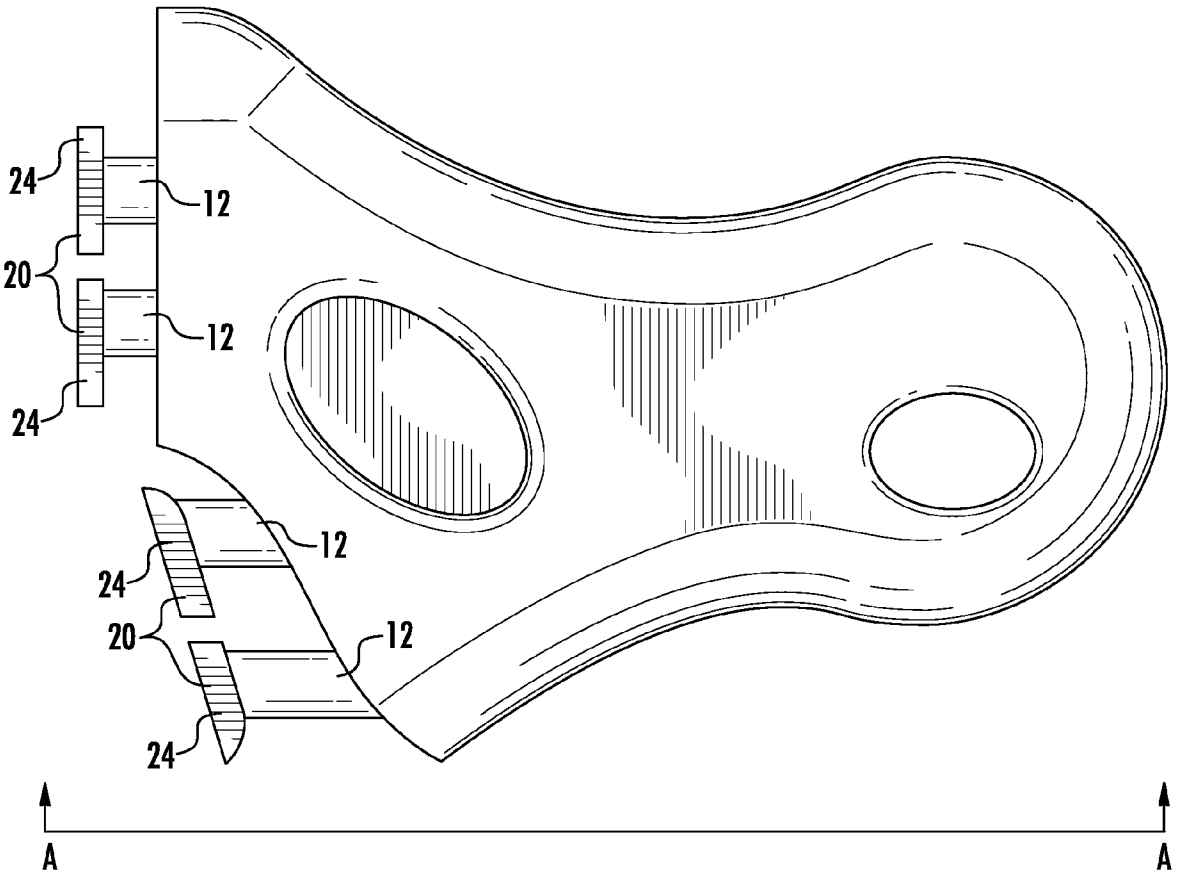
FIG. 5 is a second view of the upper portion, or flexible section, of the Dual-material Paintbrush Handle with Internal Fixation.

Referring to FIG. 5, a second view of the upper portion, or flexible section, of the Dual-material Paintbrush Handle with Internal Fixation is shown.

The locking tips 20 in FIG. 5 are shown as discrete locking tips 24. A discrete locking tip 22 is a single locking tip 20 per projection 12.

Figure 6:
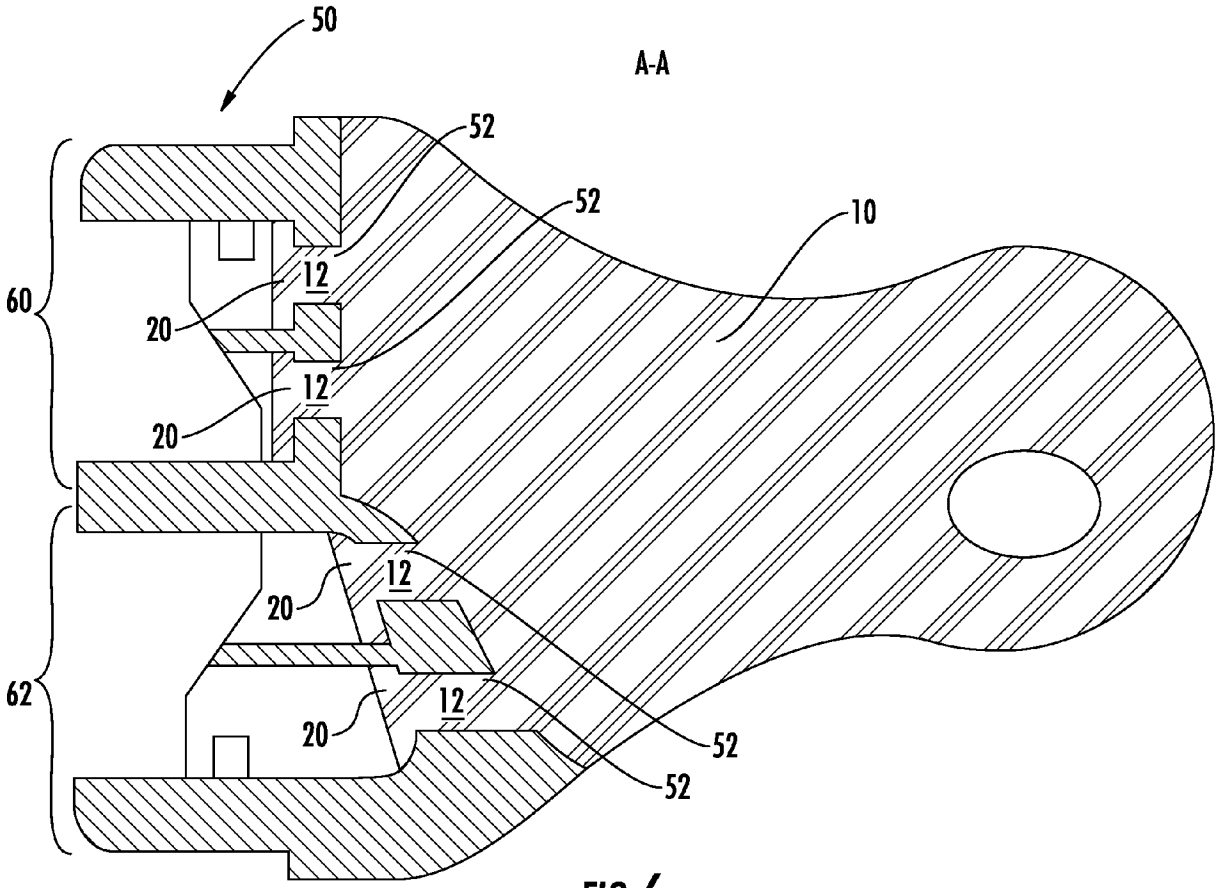
FIG. 6 is a cross-sectional view of the Dual-material Paintbrush Handle with Internal Fixation.

Referring to FIG. 6, a cross-sectional view of the Dual-material Paintbrush Handle with Internal Fixation is shown.

As shown, flexible section 10 includes projections 12 that pass through bores 52, locking the flexible section 10 to the transition section 50. The projections 12 are shown with optional locking tips 20.

Also shown are the standard fixation section 60 and the enlarged fixation section 62. In the embodiment shown, the projections 12 of the enlarged fixation section 62 are longer than those of the standard fixation section 60, but additional space remains available for even larger projections 12 and locking tips 20.

Figure 7:
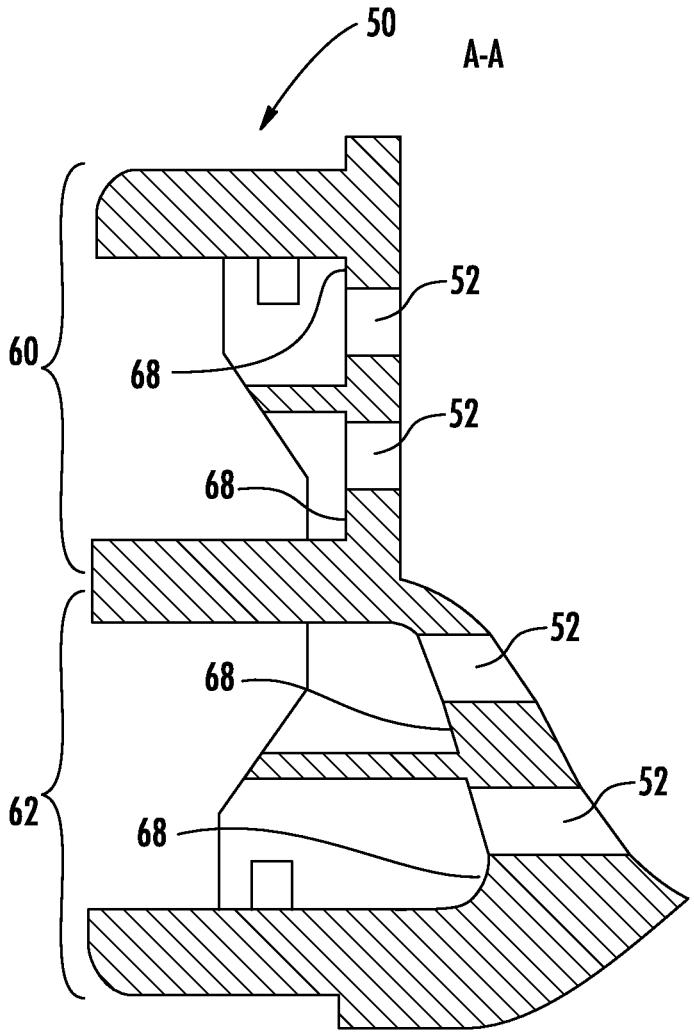
FIG. 7 is a cross-sectional view of the lower portion, or transition section, of the Dual-material Paintbrush Handle with Internal Fixation.
Figure 8:
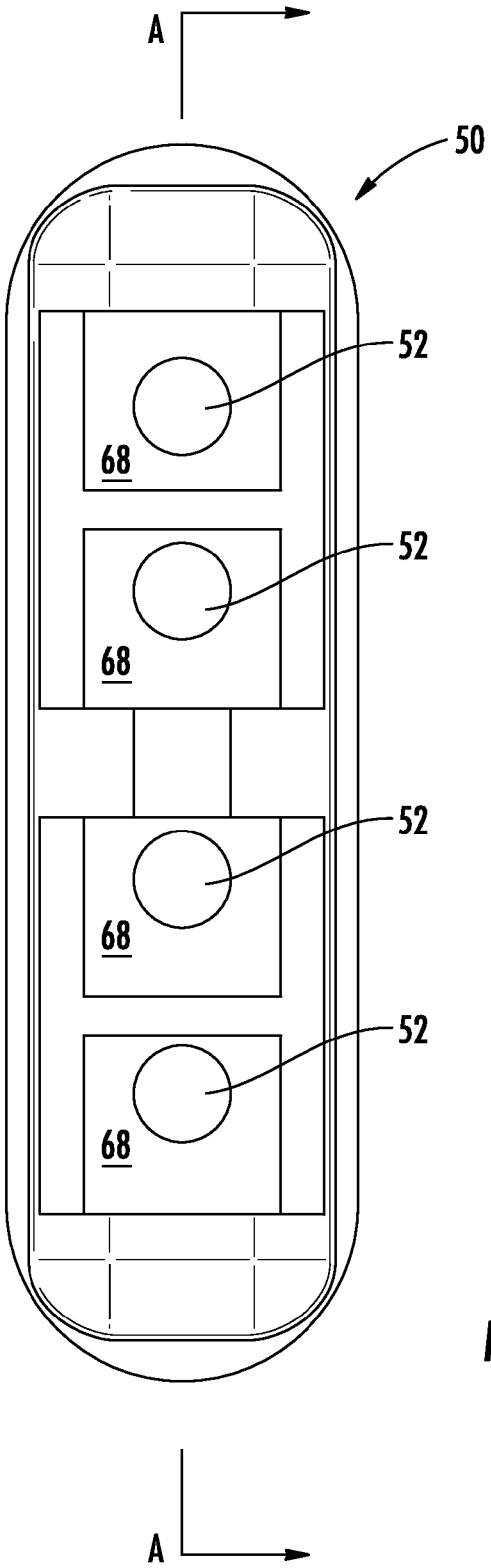
FIG. 8 is an end-on view of the lower portion, or transition section, of the Dual-material Paintbrush Handle with Internal Fixation.

Referring to FIGS. 7 and 8, a cross-sectional view and end-on view of the lower portion, or transition section, of the Dual-material Paintbrush Handle with Internal Fixation is shown.

The transition section 50 is shown alone, with the bores 52. Also shown are the locking tip interface surfaces 68, placed where the locking tips 20 (not shown) contact the transition section 50.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A flexible paintbrush handle for use with a standard paintbrush ferrule, the paintbrush handle comprising:

a. a transition section made of a substantially stiff material;
  i. the transition section further comprising:
    1. one or more penetrations;
    1. a standard fixation section with standard bores; and
    2. an enlarged fixation section with extended bores, the extended bores of greater length than the standard bores;

c. a flexible section made of a substantially flexible material;
  i. the flexible section including one or more protrusions that permanently mate with the one or more penetrations;
  ii. the one or more protrusions of the flexible section comprising:
    1. one or more shallow protrusions to mate with the standard bores; and
    2. one or more extended protrusions to mate with extended bores;

d. whereby the combination of the standard fixation section and enlarged fixation section maximizes the volume of flexible section, while creating a strong connection to the transition section.

2. The flexible paintbrush handle of claim 1 further comprising:

a. one or more locking tips at an end of the one or more protrusions;
  i. the one or more locking tips to prevent the one or more protrusions from detaching from the one or more penetrations.

3. The flexible paintbrush handle of claim 2 further comprising:

a. a locking tip interface surface within the transition section; and b. whereby the one or more locking tips engage the locking tip interface surface, preventing the flexible section from disconnecting from the transition section.

4. The flexible paintbrush handle of claim 1 further comprising:

a. one or more locking tips at an end of the one or more protrusions;

b. the one or more locking tips connecting at least two of the one or more protrusions; and c. the one or more locking tips to prevent the one or more protrusions from detaching from the one or more penetrations.

5. The flexible paintbrush handle of claim 1 wherein the one or more protrusions is two or more protrusions, and the two or more protrusions are of disparate lengths.

6. The flexible paintbrush handle of claim 5 wherein penetrations are of two or more lengths, corresponding to the disparate lengths of the two or more protrusions.

7. A paintbrush handle comprising:

a. a transition piece of stiffness similar to a paintbrush ferrule;
  i. the transition piece including a first section and a second section;
  ii. the first section including bores of a first length; and
  iii. the second section including bores of a second length that is greater than the first length;

b. a flexible member;
  i. the flexible member including protrusions of a first length and a second length, the second length greater than the first length;
  ii. the protrusions of the first length coupled to the bores of the first length; and
  iii. the protrusions of the second length coupled to the bores of the second length.

8. The paintbrush handle of claim 7 further comprising:

a. a locking tip connected to one or more of the protrusions, the locking tip preventing the protrusion from passing through its respective bore.

9. The paintbrush handle of claim 8 wherein the locking tip connects to two or more protrusions.

10. The paintbrush handle of claim 7 wherein the flexible member penetrates the transition piece, but the transition piece does not penetrate the flexible member.

11. The paintbrush handle of claim 7 wherein the protrusions of the flexible section are formed by co-injection of plastic into a single mold to form the flexible member and the transition piece.

12. The paintbrush handle of claim 7, wherein the protrusions are generally round in cross-section.

* * * * *